US008387490B2

(12) United States Patent
Lee

(10) Patent No.: US 8,387,490 B2
(45) Date of Patent: Mar. 5, 2013

(54) TOOL WITH PIVOTABLE AND SLIDABLE HANDLES

(76) Inventor: Hong-Jen Lee, Taichung (TW)

( * ) Notice: Subject to any disclaimer, the term of this patent is extended or adjusted under 35 U.S.C. 154(b) by 195 days.

(21) Appl. No.: 13/078,015

(22) Filed: Apr. 1, 2011

(65) Prior Publication Data

US 2012/0247279 A1 Oct. 4, 2012

(51) Int. Cl.
*B25B 23/16* (2006.01)
*B25G 1/00* (2006.01)

(52) U.S. Cl. ..... 81/177.7; 81/177.8; 81/177.85

(58) Field of Classification Search ..... 81/177.5, 81/177.6, 177.7, 177.8, 177.9, 177.85
See application file for complete search history.

(56) References Cited

U.S. PATENT DOCUMENTS

| | | | | |
|---|---|---|---|---|
| 6,260,452 | B1 * | 7/2001 | Yu | 81/177.2 |
| 6,412,373 | B1 * | 7/2002 | Hsiao | 81/177.7 |
| 6,640,672 | B1 * | 11/2003 | Cheng | 81/177.5 |
| 7,040,200 | B2 * | 5/2006 | Lin | 81/177.5 |
| 7,082,863 | B1 * | 8/2006 | Wang | 81/177.85 |
| 7,228,766 | B1 * | 6/2007 | Shyu | 81/177.1 |
| 7,311,018 | B1 * | 12/2007 | Liou | 81/60 |
| 7,494,304 | B2 * | 2/2009 | McAuliffe | 408/240 |
| 2005/0252348 | A1 * | 11/2005 | Ting | 81/177.5 |
| 2007/0199412 | A1 * | 8/2007 | Lee | 81/177.85 |

* cited by examiner

*Primary Examiner* — David B Thomas

(57) ABSTRACT

A tool includes a head member and two pivotably connected rods. The head member has a passage defined transversely therethrough and the rods extends through the passage. A driving head is connected to the head member. When the pivotal portions of the two rods are located within the passage, the two rods form a straight and solid bar. When the pivotal portions of the two rods are located outside of the passage, the two rods are pivotable relative to each other so as to be used in different situations.

15 Claims, 18 Drawing Sheets

TOOL WITH PIVOTABLE AND SLIDABLE HANDLES

FIELD OF THE INVENTION

The present invention relates to a tool, and more particularly, to a tool with two rods slidably extending through the head member, and the two rods are pivotable relative to the each other.

BACKGROUND OF THE INVENTION

A conventional tool with slidable handle is disclosed in U.S. Pat. No. 1,457,570 and includes a head member with a stepped recess defined axially therein and a transverse hole is defined through the head member. The stepped recess communicates with the transverse hole. A handle extends through the transverse hole, and a bead and spring are located in the stepped recess so that a part of the bead protrudes out from the stepped recess to contact against the handle. When the handle is slid, the bead provides proper resistance.

However, the handle can only be moved left and right, and the handle is a solid and straight rod which cannot be bent or deformed according needs. The handle could drop out from the head member because there is no restriction mechanism to stop the movement of the handle relative to the head member.

The present invention intends to provide a tool with slidable rods which can be moved left and right, and can be pivoted relative to the head member.

SUMMARY OF THE INVENTION

The present invention relates to a tool which includes a head member and two pivotably connected rods. The head member has a passage defined transversely therethrough and the rods extends through the passage. A driving head is connected to the head member. When the pivotal portions of the two rods are located within the passage, the two rods form a straight and solid bar. When the pivotal portions of the two rods are located outside of the passage, the two rods are pivotable relative to each other so as to be used in different situations.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
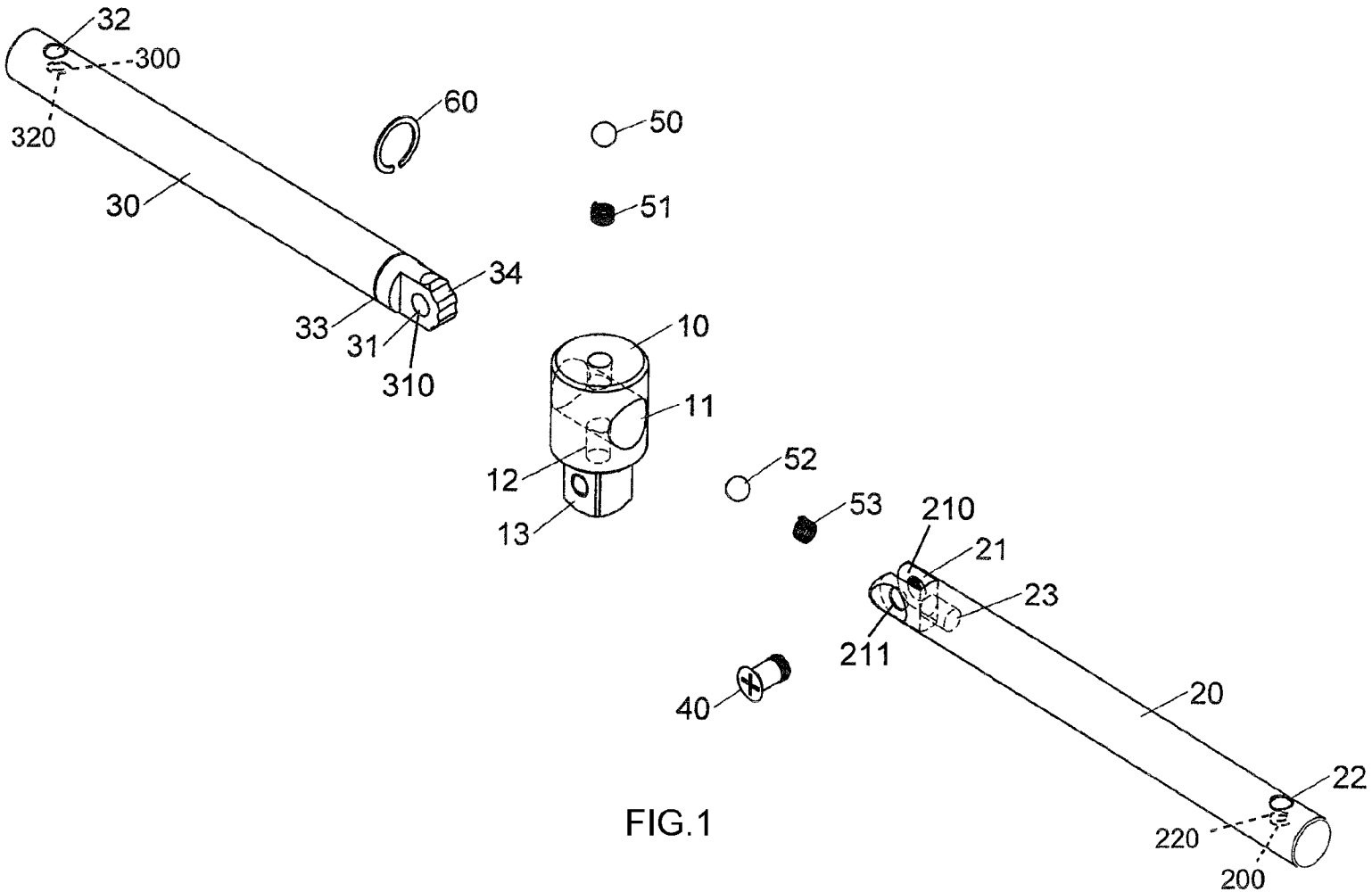
FIG. 1 is an exploded view to show the tool of the present invention.
Figure 2:
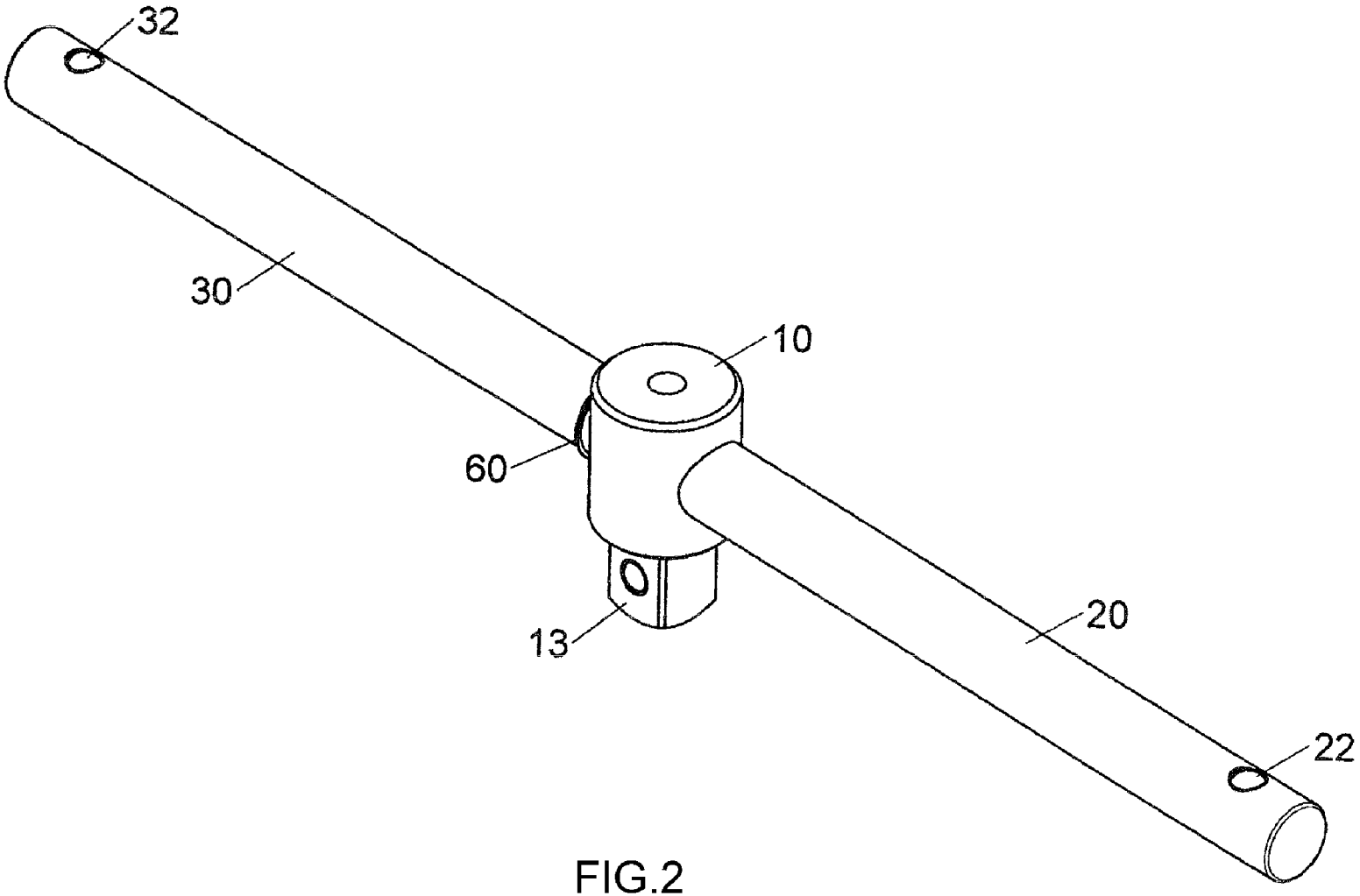
FIG. 2 is a perspective view to show the tool of the present invention.
Figure 3:
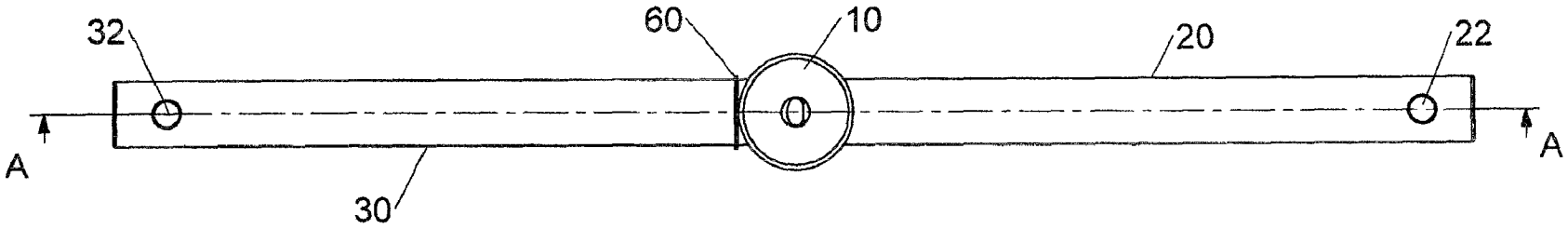
FIG. 3 is a top view of the tool of the present invention.

Referring to FIGS. 1 and 2, the tool of the present invention comprises a head member 10 having a passage 11 defined transversely therethrough and a first recess 12 is defined axially therein. A rectangular first driving head 13 is connected to the head member 10 so as to be connected with a socket.

A first rod 20 slidably passes through the passage 11 and the first end of the first rod 20 has a first pivotal portion 21 which has a U slot 210. A first hole 211 is defined through the first pivotal portion 21 and communicates with the U slot 210. The axis of the first rod 20 is perpendicular to the axis of the head member 10. A first restriction portion 22 partially protrudes from the periphery of the second end of the first rod 20. The first restriction portion 22 is a bead which is pushed by a spring 220 and both of which are located in the reception hole 200 defined in the first rod 20. The partially protruding first restriction portion 22 prevents the first rod 20 from dropping from the passage 11. When the first restriction portion 22 is pushed in to the reception hole 200, the first rod 20 can be removed from the head member 10. The first rod 20 further has a second recess 23 defined in the first end thereof and the second recess 23 communicates with the U slot 210.

A second rod 30 slidably passes through the passage 11 and the first end of the second rod 30 has a second pivotal portion 31 which has a second hole 310. The second hole 310 of the second pivotal portion 31 is pivotably connected to the first hole 211 of the first pivotal portion 21 by extending a pin 40 therethrough. A second restriction portion 32 partially protrudes from the periphery of the second end of the second rod 30. The second restriction portion 32 is a bead which is pushed by a spring 320 and both of which are located in the reception hole 300 defined in the second rod 30. The partially protruding second restriction portion 32 prevents the second rod 30 from dropping from the passage 11. When the second restriction portion 32 is pushed in to the reception hole 300, the second rod 30 can be removed from the head member 10. The second rod 30 has a groove 33 defined in the outer surface thereof and located close to the second pivotal portion 31. The second pivotal portion 31 has multiple notches 34 defined along the outer surface thereof and the notches 34 are located around the axis of the second hole 310. The second recess 23 is located in alignment with one of the notches 34 when the first and second rods 20, 30 are pivoted an angle.

The pin 40 is a bolt and extends through the first and second pivotal portions 21, 31 and is secured to the first pivotal portion 21.

A first spring 51 and a first member 50 are located in the first recess 12 and the first member 50 is pushed by the first spring 51 to protrude into the passage 11.

A second spring 53 and a second member 52 are located in the second recess 23 and the second member 52 is pushed by the second spring 53 to engage with one of the notches 34.

The second rod 30 is pivotable about the pin 40 and relative to the first rod 20 when the first and second pivotal portions 21, 31 are located outside of the head member 10.

Figure 4:
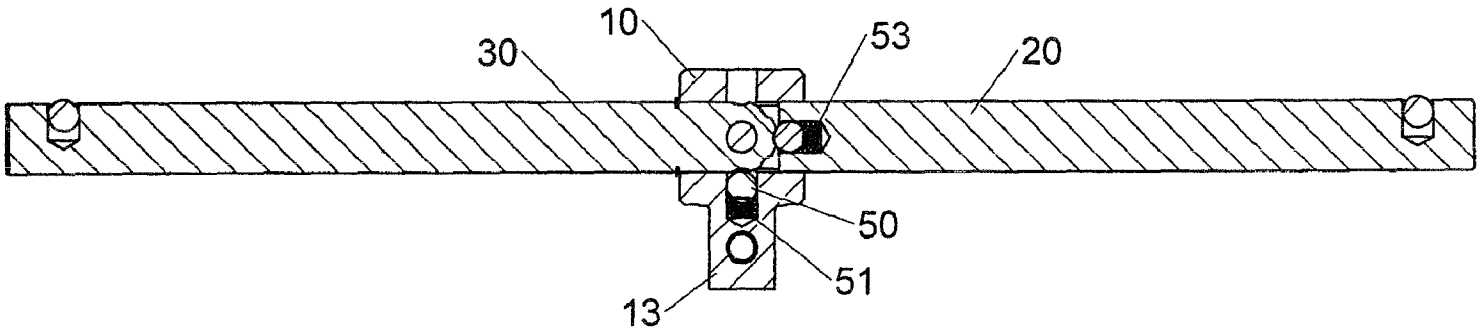
FIG. 4 is a cross sectional view, taken along line A-A in FIG. 3.

As shown in FIGS. 1 and 4, the second rod 30 has a groove 33 defined in the outer surface thereof and located beside the second pivotal portion 31. A clip 60 is engaged with the groove 33 and the outer diameter of the clip 60 is larger than the inner diameter of the passage 11. When the clip 60 contacts an end of the head member 10 where the passage 11 is defined through, the first recess 12 is located in alignment with one of the notches 34, and the first member 50 is engaged with the notch 34, and the first and second pivotal portions 21, 31 are located within the passage 11. When the first and second pivotal portions 21, 31 are located outside of the head member 10, the second rod 30 is pivotable about the pin 40 and relative to the first rod 20.

Figure 5:
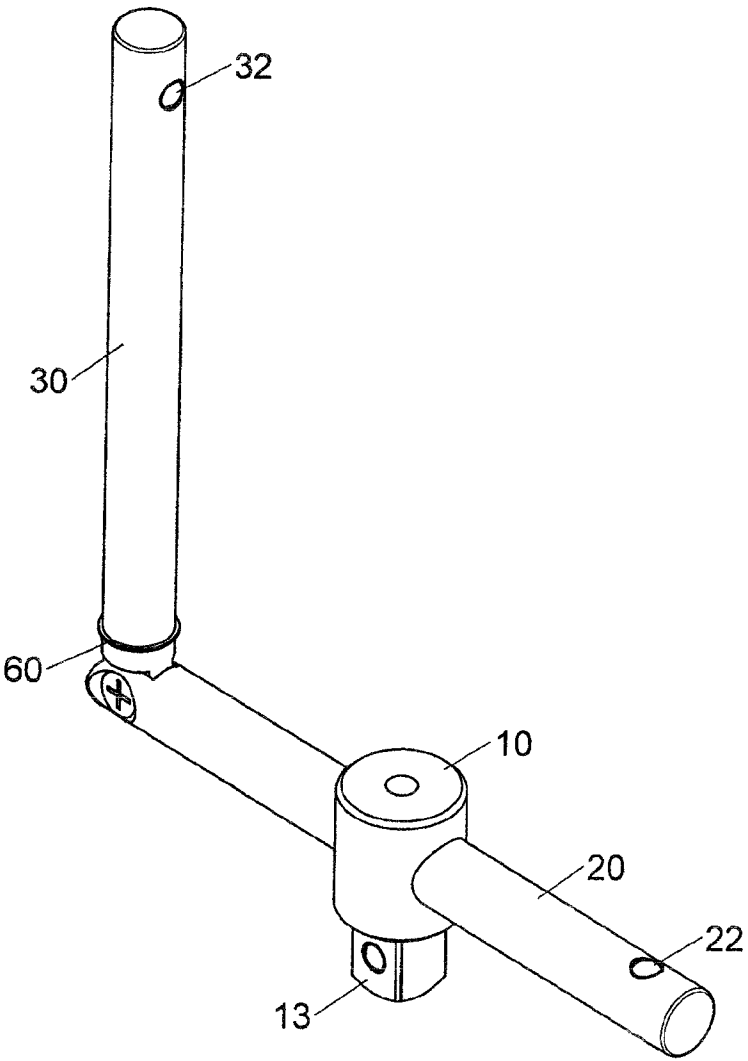
FIGS. 5 and 6 show two operation statuses of the tool of the present invention.
Figure 6:
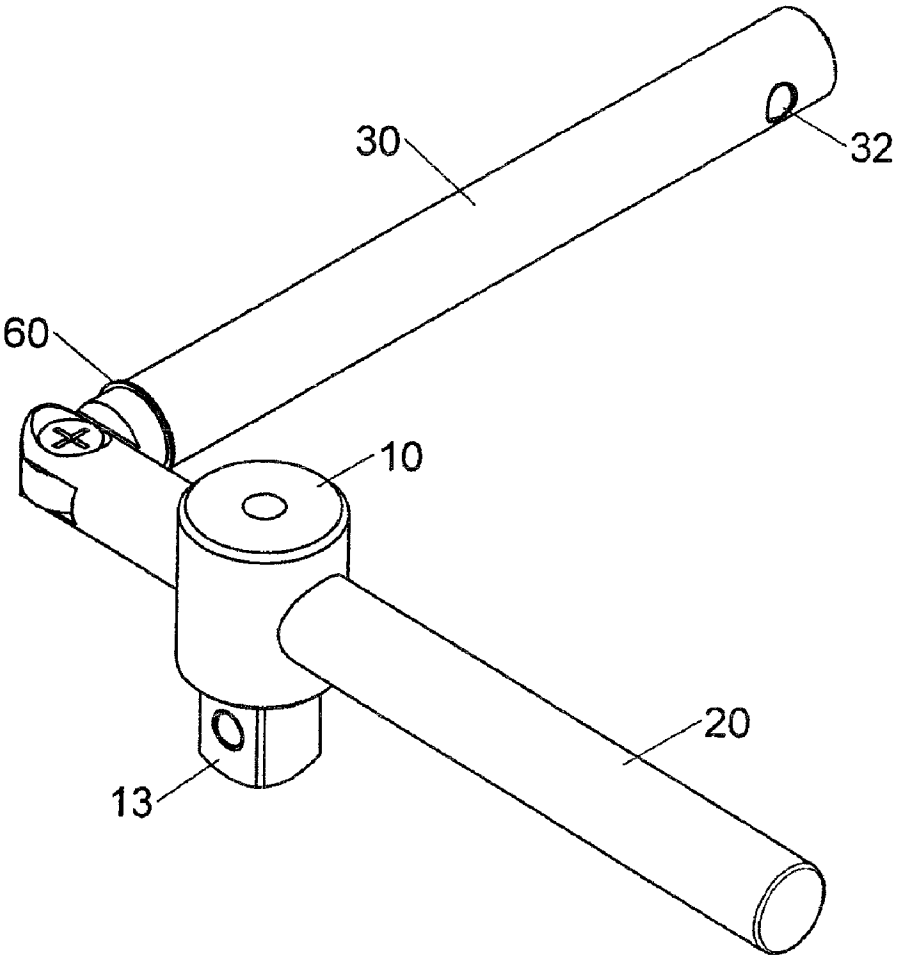

As shown in FIG. 5, when the second rod 30 is moved away from the head member 10, the first member 50 is disengaged from the notch 34, the second rod 30 is pivoted about the pin 34 and perpendicular to the first rod 20. The user holds the second rod 30 to drive the first rod 20 and the head member 10 to rotate the head member 10 quickly. As shown in FIG. 6, the first rod 20 is pivoted relative to the second rod 30 and the head member 10.

Figure 7:
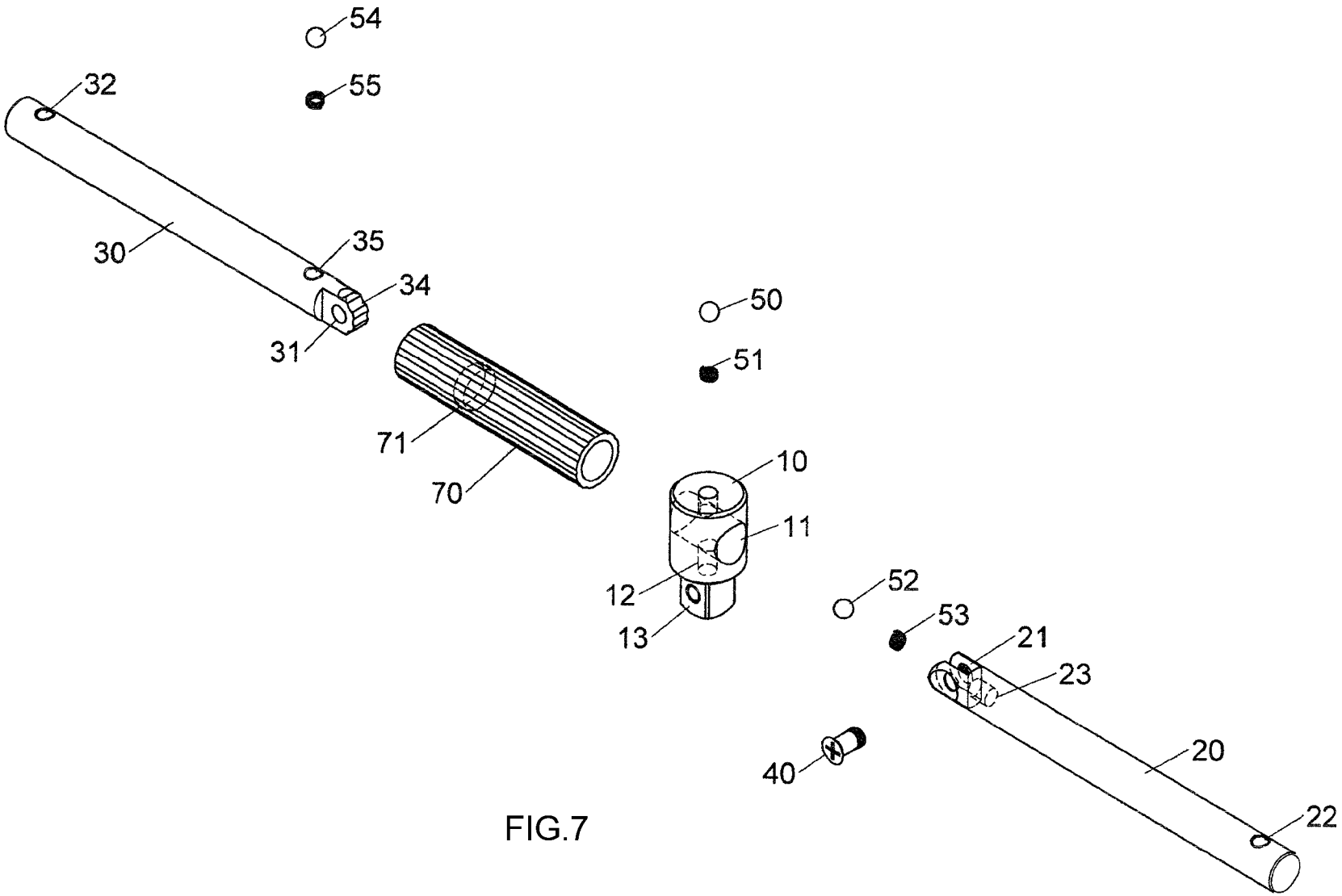
FIG. 7 is an exploded view to show the second embodiment of the tool of the present invention.
Figure 8:
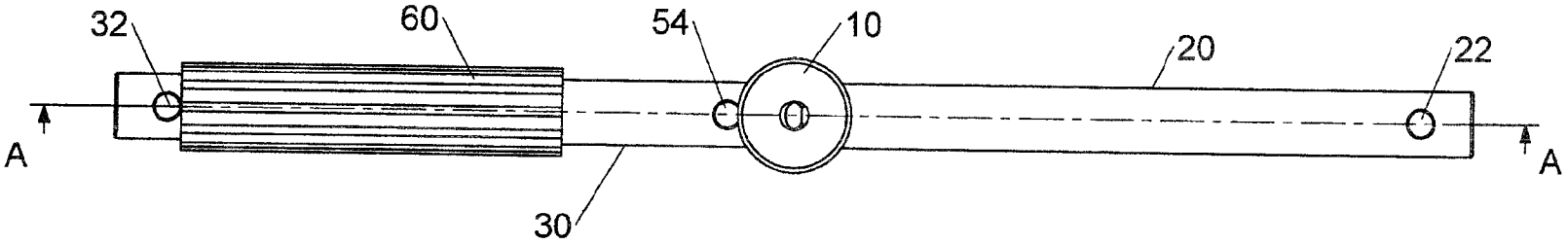
FIG. 8 is a top view of the tool of the present invention.
Figure 9:
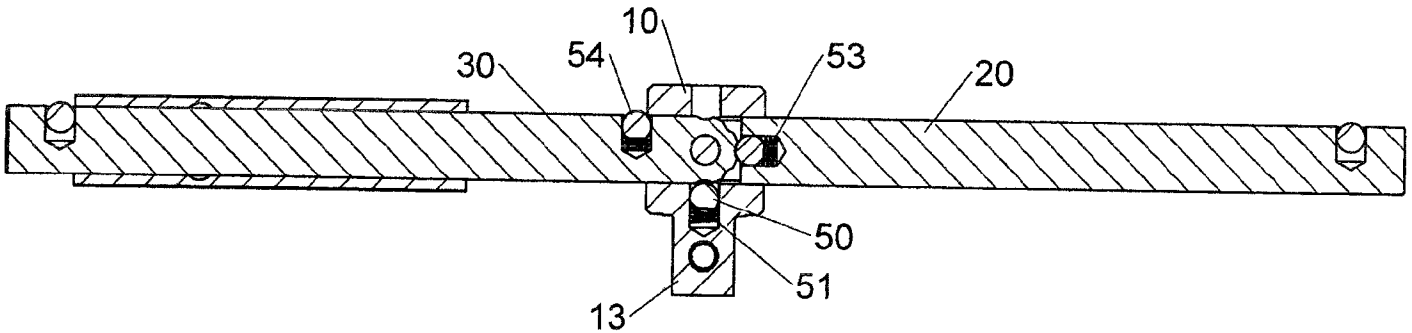
FIG. 9 is a cross sectional view, taken along line A-A in FIG. 8.

As shown in FIGS. 7 to 9, the second rod 30 does not have the groove 33 and has a third recess 35 located beside the second pivotal portion 31. The axis of the third recess 35 is perpendicular to the axis of the second rod 30. A third spring 55 and a third member 54 are located in the third recess 35. The third member 54 is a bead and pushed by the third spring 55 so as to partially protrude out from the third recess 35. A sleeve 70 is slidably mounted to the second rod 30 and has a groove 71 is defined in the inner periphery thereof.

Figure 10:
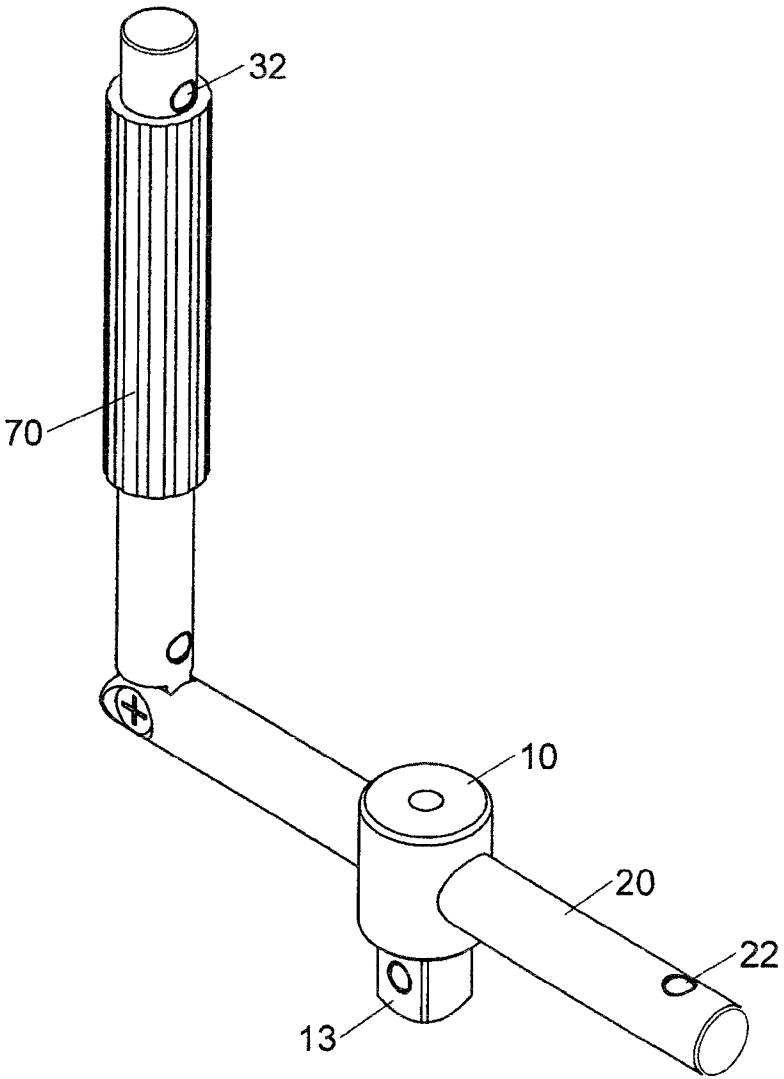
FIGS. 10 and 11 show two operation statuses of the second embodiment of the tool of the present invention.

As shown in FIG. 10, when the first rod 20 is perpendicular to the second rod 30, the user holds the sleeve 70 and drives the second rod 30, the first rod 20 and the head member 10 are rotated. The sleeve 70 does not rotate relative to the user's hand.

Figure 11:
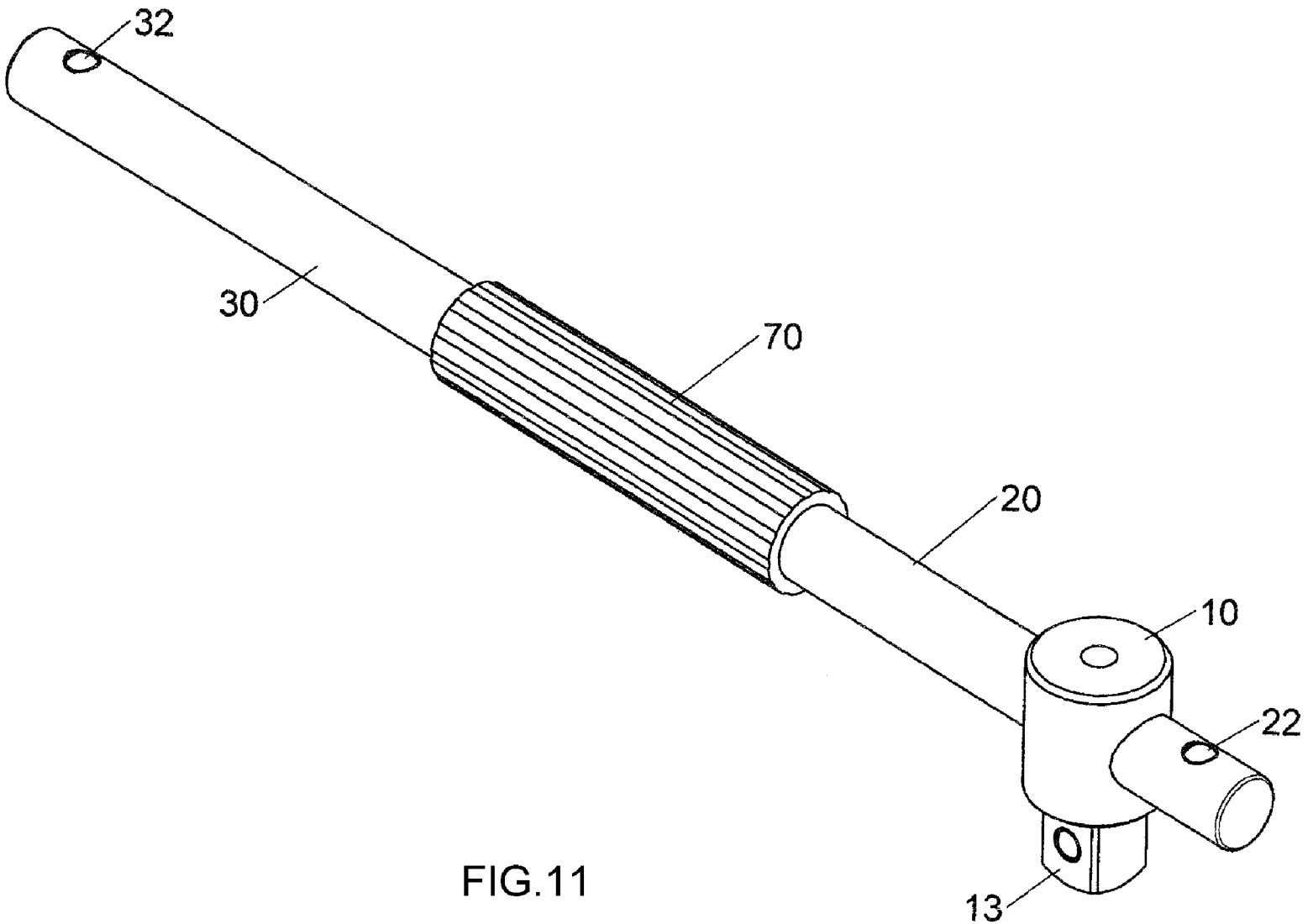

As shown in FIG. 11, when the head member 10 is moved to the first end of the first rod 20, the third member 54 is engaged with the groove 71 in the sleeve 70, the first and second rods 20, 30 form a straight and solid bar.

Figure 12:
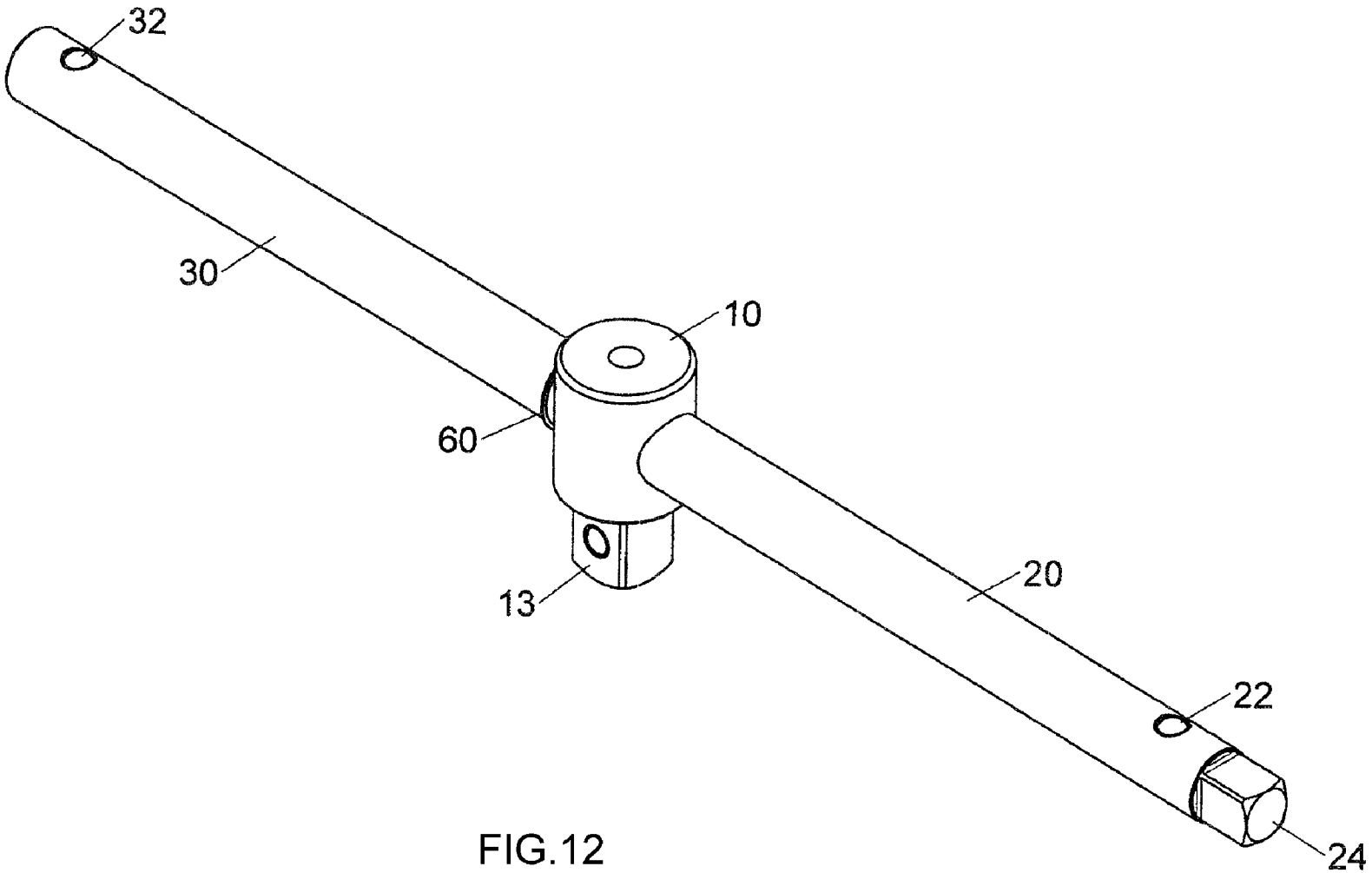
FIG. 12 is an exploded view to show the third embodiment of the tool of the present invention.

As shown in FIG. 12, the first rod 20 has a second driving head 24 extending therefrom, and the first and second driving heads 13, 24 are rectangular heads and have different sizes.

Figure 13:
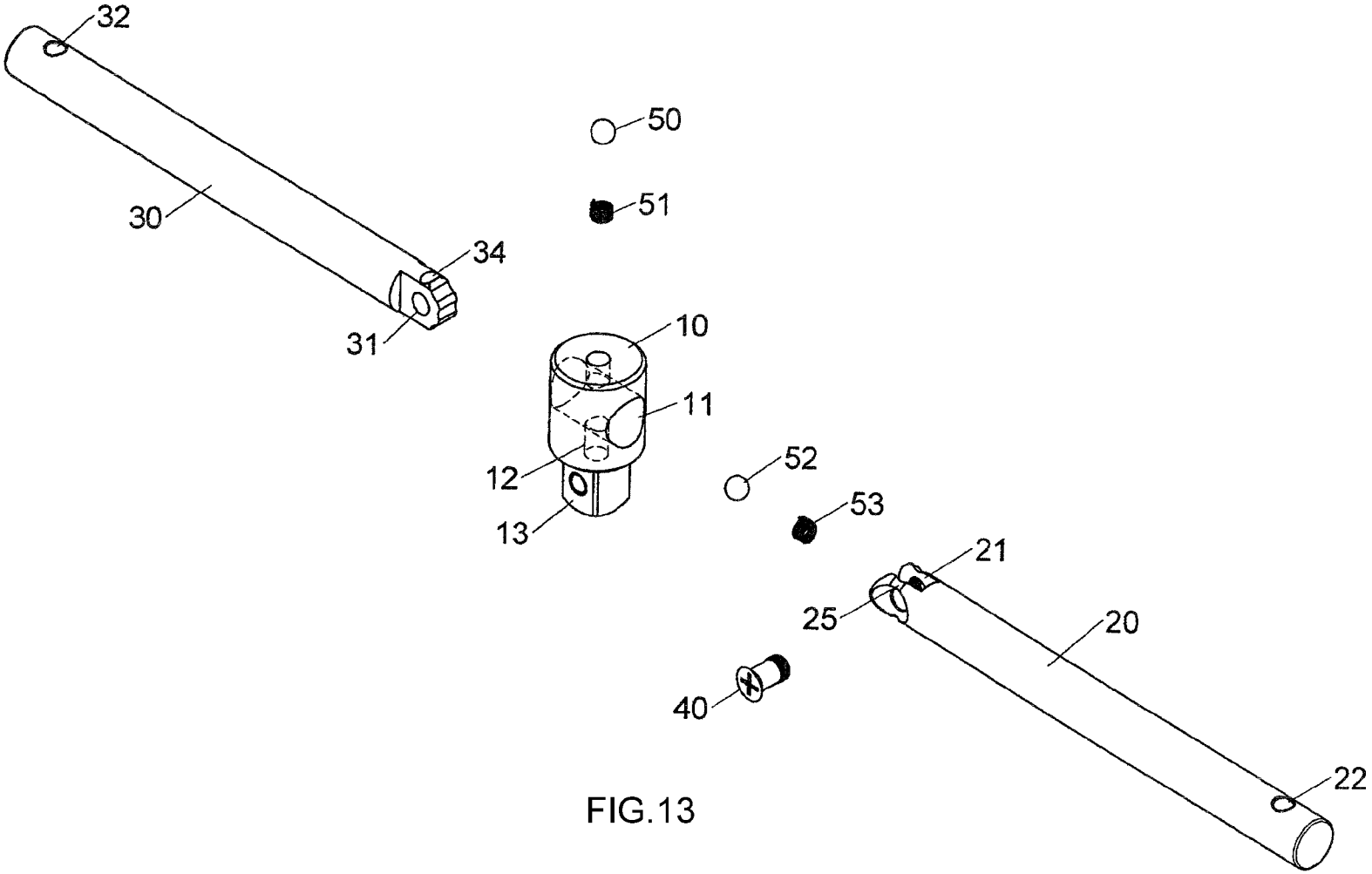
FIG. 13 is an exploded view to show the fourth embodiment of the tool of the present invention.
Figure 14:
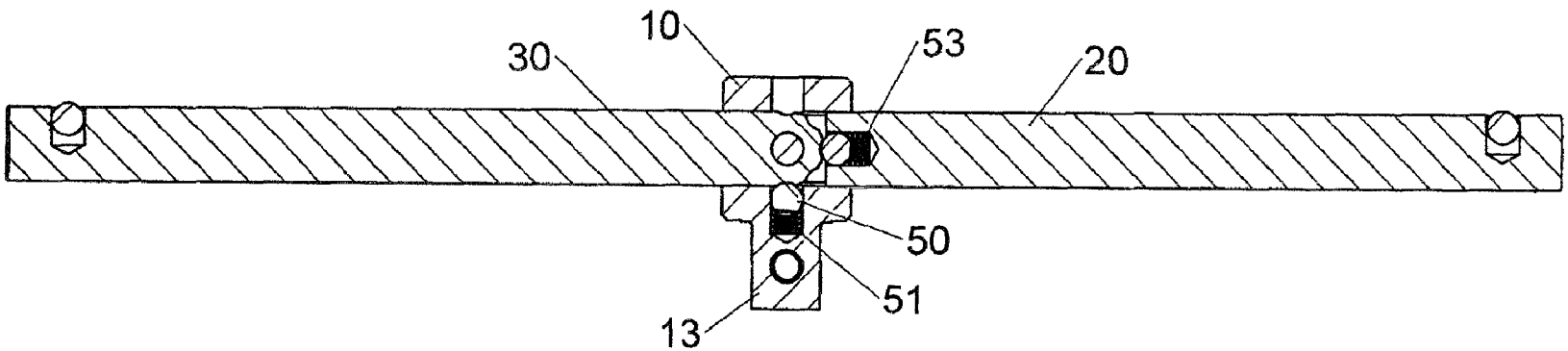
FIG. 14 is a cross sectional view to show the fourth embodiment of the tool of the present invention.

As shown in FIGS. 13 and 14, there are no groove 33 and clip 60, the first pivotal portion 21 has an engaging portion 25 which is a ring-shaped portion and located corresponding to the first recess 12. When the first member 50 is engaged with the engaging portion 25, the first and second rods 20, 30 form a straight and solid bar and extend evenly from two ends of the head member 10.

Figure 15:
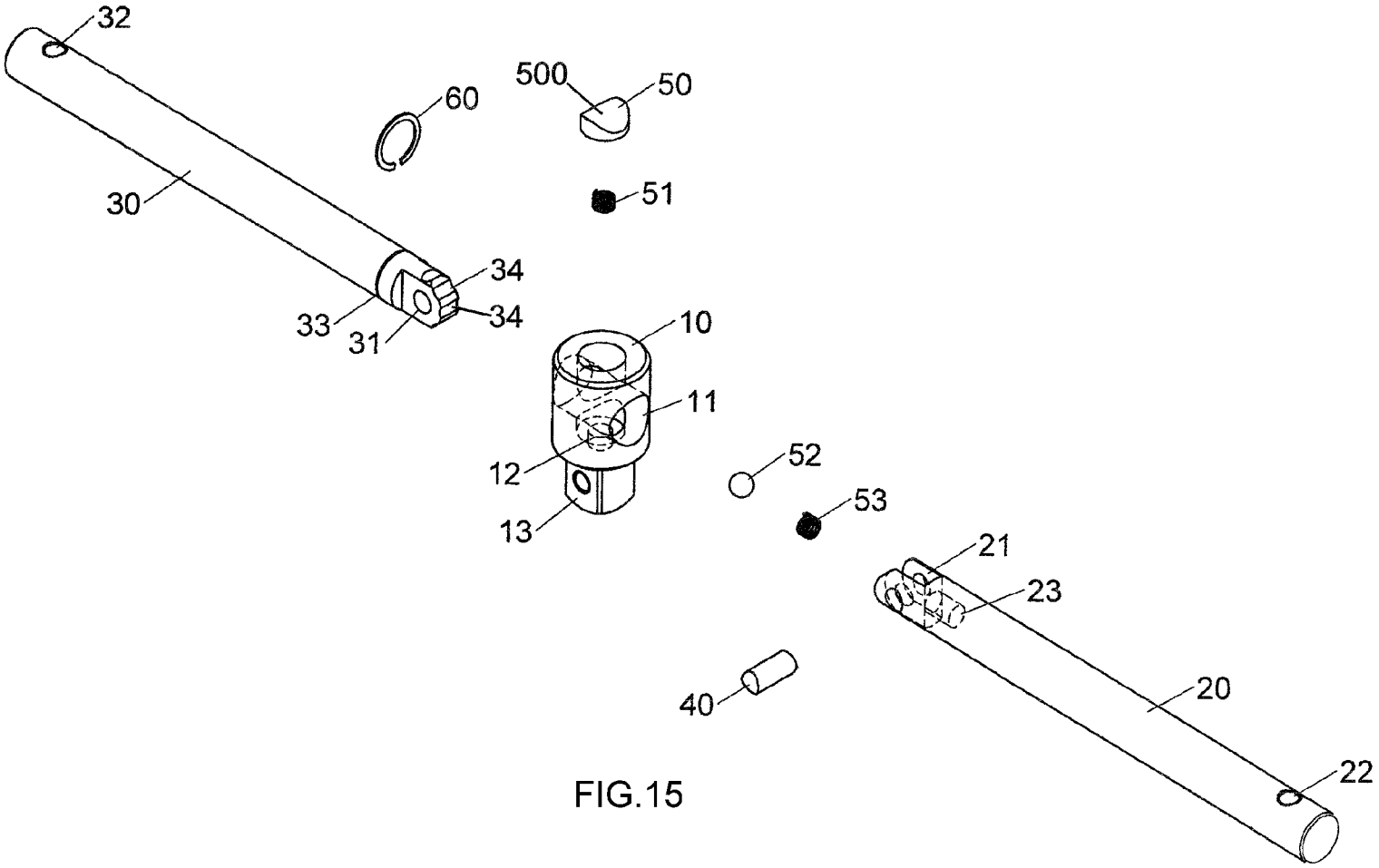
FIG. 15 is an exploded view to show the fifth embodiment of the tool of the present invention.
Figure 16:
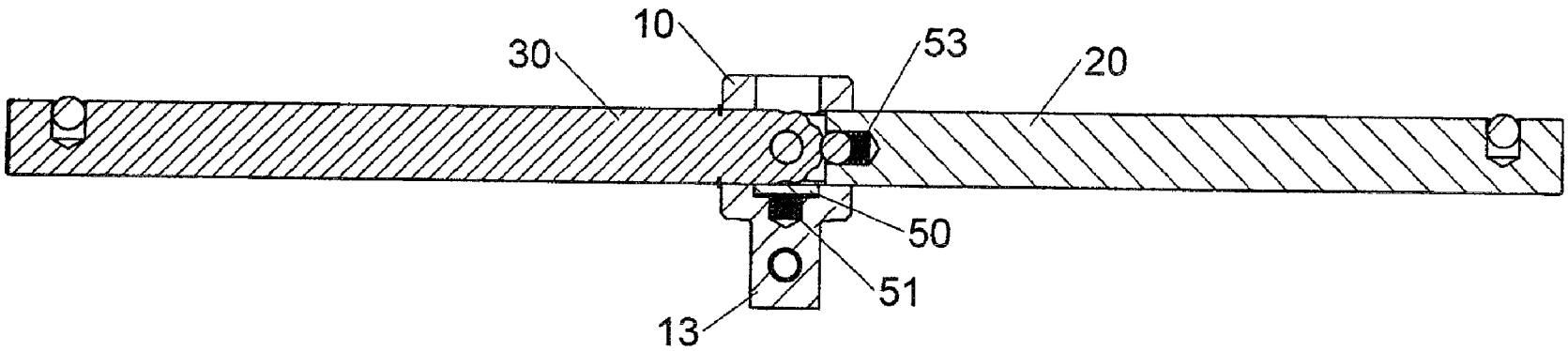
FIG. 16 is a cross sectional view of the fifth embodiment of the tool of the present invention.

As shown in FIGS. 15 and 16, the first recess 12 has a stepped inner periphery and the first restriction member 50 is a cylindrical member which has a curved recess 500 whose curvature is matched with the outer surface of each of the first and second rods 20, 30.

Figure 17:
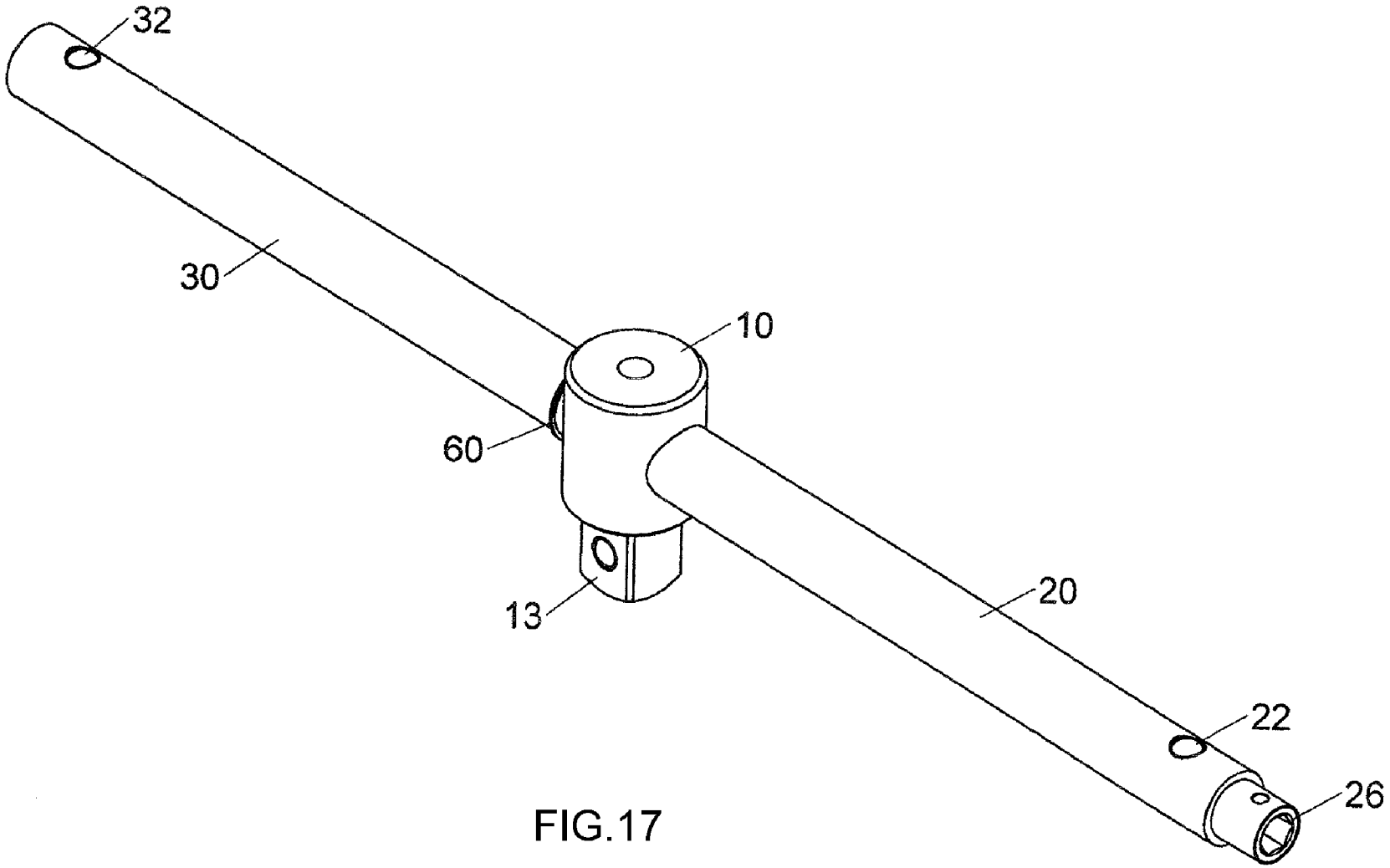
FIG. 17 is a perspective view to show the sixth embodiment of the tool of the present invention.

As shown in FIG. 17, the first rod 20 has a receiving portion 26 which is a polygonal recess which can be a hexagonal recess or a dodecagonal recess.

Figure 18:
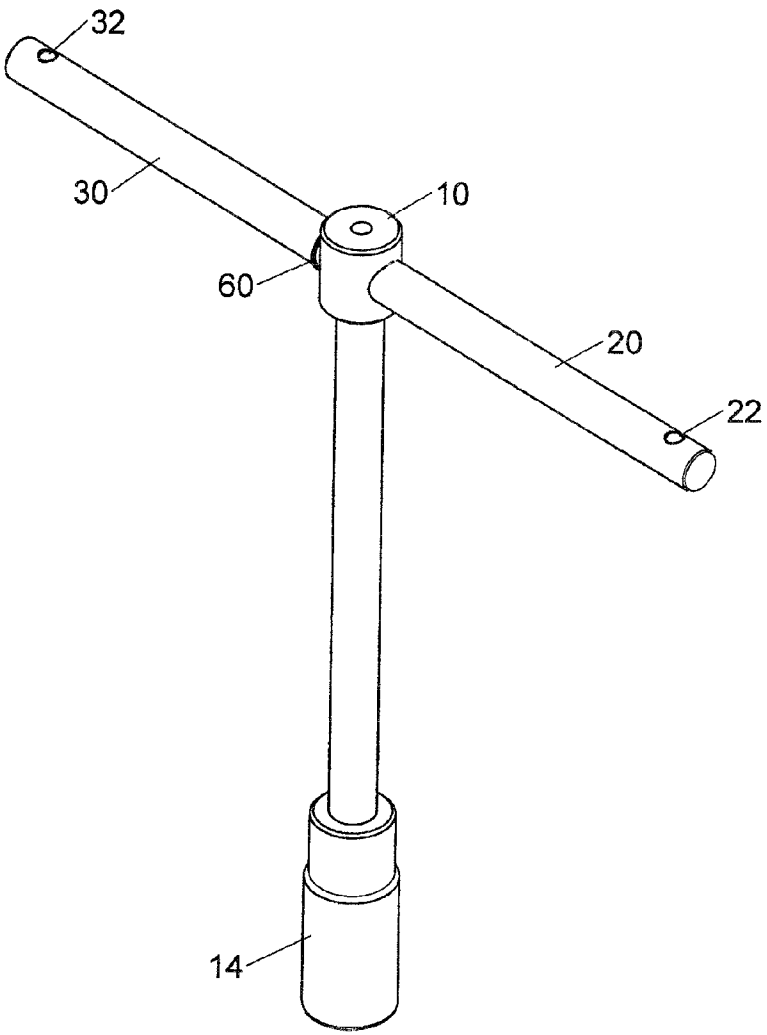
FIG. 18 is a perspective view to show the seventh embodiment of the tool of the present invention.

As shown in FIG. 18, the head member 10 has an extension on one end thereof and a driving head 14 is connected to the extension. The driving head 14 can be a socket. The head member 10, the first rod 20 and the second rod 30 form a T-bar structure.

Figure 19:
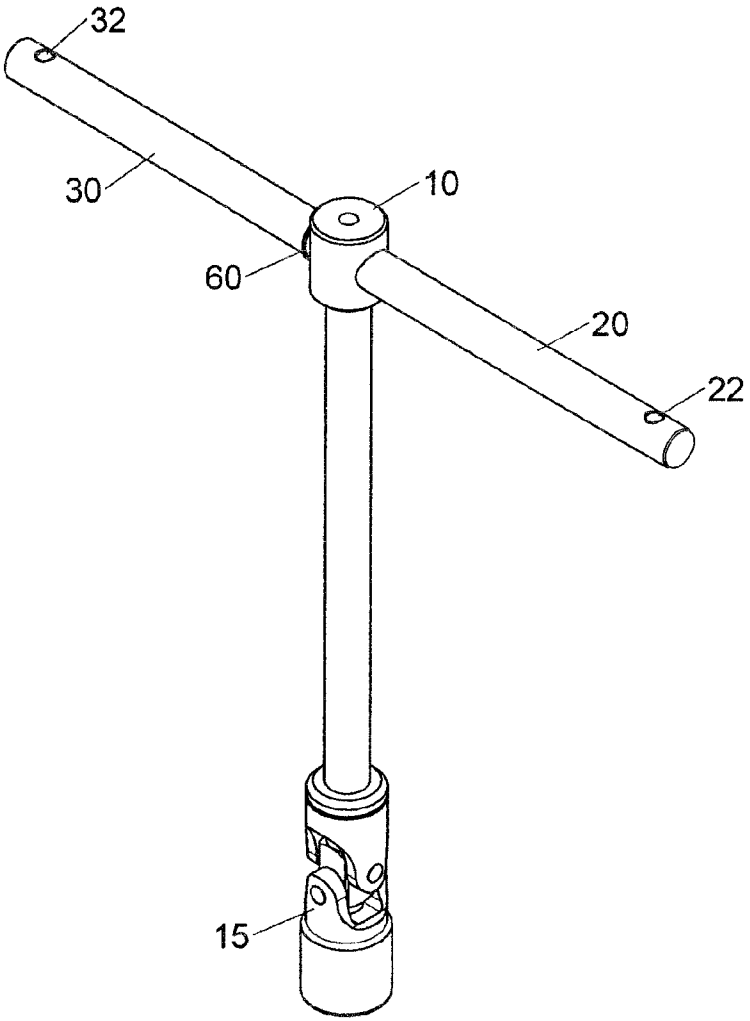
FIG. 19 is a perspective view to show the eighth embodiment of the tool of the present invention.

As shown in FIG. 19, the head member 10 has a universal mechanism which is connected with a driving head 15 which is a socket.

Figure 20:
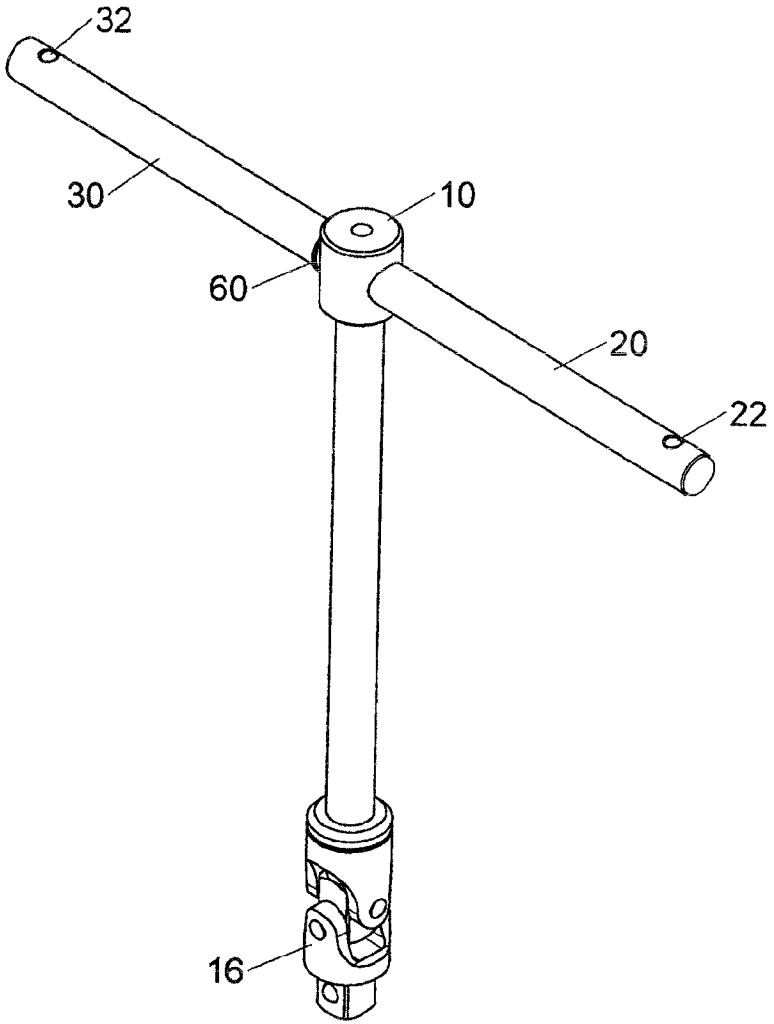
FIG. 20 is a perspective view to show the ninth embodiment of the tool of the present invention.

As shown in FIG. 20, the head member 10 has a universal mechanism which is connected with a driving head 15 which is a rectangular head.

The first and second rods 20, 30 pass through the passage 11 of the head member 10 and can be set as a straight and solid bar or a pivoted relative to each other to meet different requirements in different situations. The straight and solid bar mode is used to unscrew a bolt or a nut, when the bolt or nut is loosened, the first and second rods 20, 30 are then pivoted to quickly rotate the bolt or nut. The first and second rods 20, 30 each have restriction portion to prevent them from dropping from the passage 11. The second rod 30 may have a sleeve 70 mounted thereto so that the user can hold the sleeve 70 to operate. The sleeve 70 can also set the first and second rods 20, 30 as a straight and solid bar to increase the length of the arm of force. The head member 10 and the first rod 20 each have a driving head to provide more functions.

While we have shown and described the embodiment in accordance with the present invention, it should be clear to those skilled in the art that further embodiments may be made without departing from the scope of the present invention.

What is claimed is:

1. A tool comprising:

a head member having a passage defined transversely therethrough and a first recess defined axially therein, a first driving head connected to the head member;

a first rod slidably passing through the passage and a first end of the first rod having a first pivotal portion which has a U slot, a first hole defined through the first pivotal portion and communicating with the U slot, a first restriction portion partially protruding from a periphery of a second end of the first rod, the first rod having a second recess defined in the first end thereof, the second recess communicating with the U slot;

a second rod slidably passing through the passage and a first end of the second rod having a second pivotal portion which has a second hole, the second hole of the second pivotal portion pivotably connected to the first hole of the first pivotal portion by extending a pin therethrough, a second restriction portion partially protruding from a periphery of a second end of the second rod, the second pivotal portion having multiple notches defined along an outer surface thereof and the notches located around an axis of the second hole, the second recess being located in alignment with one of the notches;

a first spring and a first member located in the first recess and the first member being pushed by the first spring to protrude into the passage;

a second spring and a second member located in the second recess and the second member being pushed by the second spring to engage with one of the notches, and the second rod being pivotable about the pin and relative to the first rod when the first and second pivotal portions are located outside of the head member.

2. The tool as claimed in claim 1, wherein the second rod has a groove defined in an outer surface thereof and located beside the second pivotal portion, a clip is engaged with the groove and an outer diameter of the clip is larger than an inner diameter of the passage, when the clip contacts an end of the head member where the passage is defined through, the first recess is located in alignment with one of the notches, the first member is engaged with the notch, the first and second pivotal portions are located within the passage, when the first and second pivotal portions are located outside of the head member, the second rod is pivotable about the pin and relative to the first rod.

3. The tool as claimed in claim 1, wherein a third recess is located beside the second pivotal portion and an axis of the third recess is perpendicular to an axis of the second rod, a third spring and a third member are located in the third recess, the third member is pushed by the third spring and partially protrudes out from the third recess, a sleeve is slidably mounted to the second rod and has a groove defined in an inner periphery thereof, when the head member is moved to the first end of the first rod, the third member is engaged with the groove in the sleeve, the first and second rods form a straight and solid bar.

4. The tool as claimed in claim 3, wherein each of the second and third members is a bead.

5. The tool as claimed in claim 1, wherein the first member is a bead.

6. The tool as claimed in claim 1, wherein the first recess has a stepped inner periphery and the first restriction member is a cylindrical member which has a curved recess whose curvature is matched with an outer surface of each of the first and second rods.

7. The tool as claimed in claim 1, wherein the first pivotal portion has an engaging portion which is a ring-shaped portion and located corresponding to the first recess, when the first member is engaged with the engaging portion, the first and second rods form a straight and solid bar.

8. The tool as claimed in claim 1, wherein the pin is a bolt and extends through the first and second pivotal portions and is secured to the first pivotal portion.

9. The tool as claimed in claim 1, wherein each of the first and second restriction portions is a bead.

10. The tool as claimed in claim 9, wherein each of the first and second restriction portions is pushed by a spring so as to partially protrude out form the first and second rods.

11. The tool as claimed in claim 10, wherein the first rod has a receiving portion which is a polygonal recess.

12. The tool as claimed in claim 1, wherein the first rod has a second driving head extending therefrom, the first and second driving heads are rectangular heads and have different sizes.

13. The tool as claimed in claim 12, wherein the first driving head is a rectangular head for connecting a socket.

14. The tool as claimed in claim 12, wherein the head member has a socket connected thereto, the head member and a straight and solid bar composed of the first and second rods form a T-bar structure.

15. The tool as claimed in claim 1, wherein the head member has a universal mechanism which is connected with a driving head which is a rectangular head or a socket.

* * * * *